United States Patent [19]

Powers et al.

[11] 4,252,231

[45] Feb. 24, 1981

[54] BOTTOM BOARD FEEDER APPARATUS

[75] Inventors: Earl W. Powers, Molalla; Thomas L. Baker, Sherwood, both of Oreg.

[73] Assignee: Dependable-Fordath, Inc., Sherwood, Oreg.

[21] Appl. No.: 966,254

[22] Filed: Dec. 4, 1978

[51] Int. Cl.[3] ..... B22C 21/06

[52] U.S. Cl. ..... 198/422; 53/287; 164/154; 164/324; 414/41; 414/87; 414/102

[58] Field of Search ..... 414/41, 84, 87, 102, 414/110; 164/154, 184, 185, 323, 324, 339; 53/287, 312; 198/422

[56] References Cited

U.S. PATENT DOCUMENTS

| | | | |
|---|---|---|---|
| Re. 28,735 | 3/1976 | Lund et al. | 164/195 |
| 1,304,922 | 5/1919 | Tscherning | 164/206 |
| 2,049,967 | 8/1936 | Luton | 164/181 |
| 3,406,738 | 10/1968 | Hunter | 164/183 |
| 3,643,818 | 2/1972 | Gallucci | 414/87 |
| 3,923,145 | 12/1975 | Muller | 198/422 |

OTHER PUBLICATIONS

Pacematic; Dependable-Fordath, Inc. "on sale" Dec. 8, 1977.

*Primary Examiner*—Leslie J. Paperner

*Attorney, Agent, or Firm*—Klarquist, Sparkman, Campbell, Leigh, Hall & Whinston

[57] ABSTRACT

The specification discloses a bottom board feeder apparatus for feeding bottom boards onto the top surface of mold boxes of varying heights. The bottom boards are supplied in succession to the apparatus by a first conveying line. The mold boxes are supplied in succession to a board receiving position adjacent the apparatus by a second conveying line. The apparatus includes a proximity sensor for detecting the height of a mold box in the board receiving position and an elevating mechanism responsive to the sensor for raising a bottom board so that the bottom surface of the board is at least as high as the top surface of the box. The apparatus also includes a shuttle mechanism for pushing the board onto the top surface of the box after the board has been raised. A control system including electrical and hydraulic circuits is provided for automatically controlling the cyclical operation of the apparatus.

12 Claims, 9 Drawing Figures

202
204
200
240
240
234
234
238
244
254
214
212
210
206
208
226
224
222
218
110
M
M
L
262
264
246
325
258
248
162
260
252
RW
280
306
278
BOX IN POSITION
122
308
268
BOARD IN POSITION
250
270
194
304
256
193
312
SHUTTLE MECHANISM RETRACTED / EXTENDED
42
IR
266
286
282
272
288
294
292
RAISE YOKE
314
320
318
LOWER YOKE
284
274
290
300
298
EXTEND SHUTTLE MECHANISM
316
324
322
RETRACT SHUTTLE MECHANISM
230
216
276
310
232
228

BOTTOM BOARD FEEDER APPARATUS

BACKGROUND OF THE INVENTION

The present invention relates generally to multi-station sand mold-making apparatus for producing sand molds for foundry use, and more particularly to a bottom board feeder apparatus for automatically feeding bottom boards onto the tops of mold boxes of varying heights.

Multi-station sand mold-making apparatus have been known heretofore. It is desirable that such apparatus be capable of simultaneously producing the cope (upper half) and drag (lower half) portions of a composite sand mold, the two portions being complete and assembled upon each other and ready for the molten metal pouring operation at the time they leave the apparatus. Typically, a plurality of mold boxes, each containing a mold pattern, are circulated around a closed pathway through a succession of stations at which different mold-making operations are performed.

U.S. Pat. No. 2,049,967 discloses an apparatus in which patterns and mold boxes are circulated around a closed pathway. A mold box is moved along an annular table, the table being indexed so that its rotary movement is intermittent. The mold box is moved through a series of stations at which successive steps in the mold-making operation are performed, the successive steps finally completing the mold and returning the mold box to the starting point to repeat the cycle. At one station a bottom or follow-board is manually placed by an operator on top of a mold box. The turntable is then indexed to a succeeding station at which the mold box is inverted and thereafter supported upon the bottom board.

U.S. Pat. No. Re. 28,735 discloses a similar apparatus in which four pairs of mold box sections of uniform dimensions are repeatedly indexed to move the pairs repeatedly and successively in a circular path through four stations at which different successive mold-making operations are performed. A bottom board is supported on a vertically moving platform which is raised into engagement with the bottom of the mold box prior to stripping the mold. This is in contrast to positioning the bottom board initially on top of the mold box after determining the height of the box and thereafter inverting the assembly to position the bottom board under the box prior to removing the mold from the box.

U.S. Pat. No. 1,304,922 discloses an apparatus in which a bottom board is manually placed on top of a mold box and manually clamped thereto prior to inverting the mold box and withdrawing the pattern.

SUMMARY OF THE INVENTION

It is an object of the present invention to provide an apparatus for feeding boards onto the top surfaces of boxes of varying heights.

It is another object of the present invention to provide an apparatus for feeding bottom boards onto the top surfaces of mold boxes of varying heights, the bottom boards being supplied in succession to the apparatus by a first conveying line, and the mold boxes being supplied in succession to a board receiving position by a second conveying line.

It is another object of the present invention to provide a bottom board feeder apparatus which can be adjusted to accommodate bottom boards and mold boxes of different longitudinal and lateral dimensions.

It is yet another object of the present invention to provide a shuttle mechanism for a bottom board feeder apparatus which is adapted to push a bottom board onto the top surface of a mold box.

It is still a further object of the present invention to provide a bottom board feeder apparatus with a control system for automatically controlling the cyclical operation of the apparatus.

The present invention provides an apparatus for feeding boards supplied in succession by a first conveying line, onto the top surfaces of boxes of varying heights supplied in succession to a board receiving position adjacent the first conveying line by a second conveying line. The apparatus includes sensing means for detecting the height of a box supplied to the position and elevating means responsive to the sensing means for raising a board so that the bottom surface of the board is at least as high as the top surface of the box. The apparatus further includes shuttle means for pushing the board onto the top surface of the box after the board has been raised.

DESCRIPTION OF THE PREFERRED EMBODIMENT

Figures 1, 2A, 2B, 8:
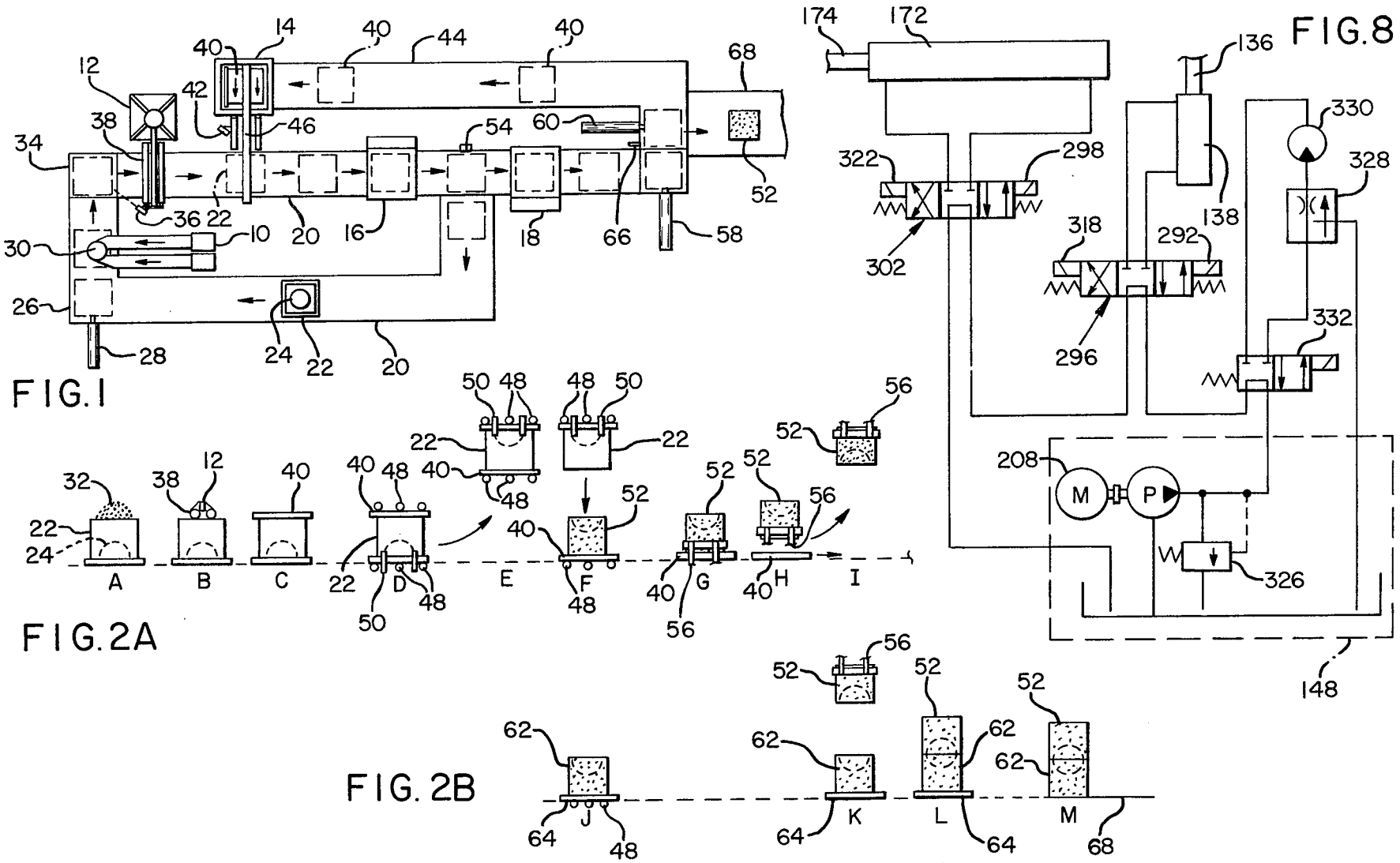
FIG. 1 shows a simplified plan view of a multi-station sand mold making apparatus which utilizes one embodiment of the bottom board feeder apparatus of the present invention.
FIG. 2A shows a functional diagram illustrating the manner in which the multi-station sand mold making apparatus of FIG. 1 forms a cope portion of a composite sand mold.
FIG. 2B shows a functional diagram illustrating the manner in which the multi-station sand mold making apparatus of FIG. 1 joins a cope portion and a drag portion to form a composite sand mold.
FIG. 8 is a schematic diagram of the hydraulic circuit forming a part of the control system of the bottom board feeder apparatus of FIG. 3.

Referring to FIGS. 1 and 2, a mixer 10, a strike off apparatus 12, a bottom board feeder apparatus 14 constructed in accordance with the present invention, a roll over draw apparatus 16, and a roll over close apparatus 18 are stationed successively along a pathway or main conveying line 20 of intermittently powered conveying rollers. A plurality of open-top mold boxes such as 22, being alternately cope and drag boxes, travel in a clockwise direction around the main conveying line 20. Each mold box contains a pattern such as indicated at 24.

First described will be the formation of a cope portion of a mold. When the mold box 22 reaches the corner 26 of the main conveying line 20 a pneumatic cylinder 28 pushes the mold box beneath the discharge end 30 of the mixer 10. A predetermined amount of sand 32 containing a binder and a catalyst is automatically poured into the mold box (FIG. 2A, step A). The amount of sand which is poured into the mold box is sufficient to fill it to a level above the upper edges of the box.

Next, the mold box 22 containing the sand 32 is conveyed to the corner 34 of the main conveying line 20 where it momentarily stops. An infrared proximity sensor 36 mounted on the strike off apparatus 12 senses the height of the mold box 22 and automatically adjusts the height of its rollers 38 so that they ride over the upper edges of the mold box when the box is conveyed past the same. At this time the binder has not yet hardened and the rollers 38 evenly distribute and slightly compact the sand 32 leaving a smooth, stable surface (FIG. 2A, step B). Excess sand falls away from the mold box.

Next, the mold box 22 is conveyed along the pathway 20 to the bottom board feeder apparatus 14 where it momentarily stops in position for receiving a bottom board such as 40. An infrared proximity sensor 42 mounted on the board elevating mechanism of the bottom board feeder apparatus senses the presence of the mold box 22. The bottom board 40 has already been conveyed along a return conveying line 44 of intermittently powered conveying rollers onto the bottom board feeder apparatus 14. The elevating mechanism of the bottom board feeder apparatus raises the bottom board 40 until the horizontal scanning beam of the sensor 42 is above the upper surface of the mold box 22. Thereafter, a shuttle mechanism 46 of the bottom board feeder apparatus feeds the bottom board laterally onto the top of the mold box (FIG. 2A, step C).

Next, the mold box 22, now covered with a bottom board 40, is conveyed along the main conveying line 20 to the roll over draw apparatus 16. The mold box 22 and the bottom board 40 are clamped between jaws of rollers 48 and arms 50 grip the bottom flange of the mold box (FIG. 2A, step D). The mold box 22 and the bottom board 40 are inverted, i.e. rolled over 180 degrees (FIG. 2A, step E). The now hardened cope portion 52 of the sand mold is lowered out of the mold box 22 with the aid of vibrating mechanisms by unclamping the jaws of rollers 48. (FIG. 2A, step F). The cope portion 52 and the bottom board 40 upon which it now rests are conveyed out of the roll over draw apparatus 16 and along the main conveying line 20 to the roll over close apparatus 18.

After the cope portion 52 and the bottom board 40 are conveyed out of the roll over draw apparatus 16, the mold box 22 is clamped between the rollers 48 and re-inverted, i.e. rolled over 180 degrees. The mold box 22 is then conveyed out of the roll over draw apparatus 16 to a box return mechanism 54 positioned between the roll over draw apparatus 16 and the roll over close apparatus 18. The mechanism 54 ejects the mold box 22 laterally and the mold box is returned along the main conveying line 20 to its original starting place.

Arms 56 of the roll over close apparatus 18 clamp the cope portion 52 and raise it off of the bottom board 40 (FIG. 2A, steps G and H). The bottom board 40 is conveyed out of the roll over close apparatus 18 to a position adjacent a pneumatic cylinder 58 which pushes the board laterally to a position adjacent a pneumatic cylinder 60. After the bottom board 40 is conveyed out of the roll over close apparatus 18, the cope portion 52 is inverted, i.e. rolled over 180 degrees (FIG. 2A, step I). The cope portion 52 is maintained in an elevated position above the level of the main conveying line 20 awaiting the arrival of a drag portion.

In a similar fashion, the multi-station sand mold making apparatus shown in FIG. 1 produces the drag portion 62 of the composite sand mold (FIG. 2B step J), the steps being the same as steps A through F (FIG. 2A). The drag portion 62 and the bottom board 64 upon which it rests are then conveyed into the roll over close apparatus 18 directly underneath the waiting cope portion 52 (FIG. 2B, step K). The cope and drag portions 52 and 62 are joined (FIG. 2B, step L) and they are conveyed, resting on top of the bottom board 64, out of the roll over close apparatus 18 to a position adjacent the pneumatic cylinder 58. The pneumatic cylinder 58 pushes the bottom board 64, and the cope and drag portions 52 and 62 carried thereby, laterally to a position adjacent the pneumatic cylinder 60. The bottom board 64 pushes the bottom board 40 onto the return conveying line 44 and the powered conveying rollers thereof convey the bottom board 40 back to the bottom board feeder apparatus 14. An infrared proximity sensor 66 senses the presence of the completed sand mold and actuates the pneumatic cylinder 60 which pushes the joined cope and drag positions 52 and 62 down a chute 68 which leads to a metal pouring station (FIG. 2B, step M). The next succeeding bottom board that is pushed laterally by the pneumatic cylinder 58 will push the bottom board 64 laterally onto the return conveying line 44 which will return it to the bottom board feeder apparatus 14.

In actual operation a plurality of mold boxes and bottom boards are simultaneously circulated about the apparatus shown in FIG. 1. A continuous succession of composite sand molds assembled and ready for the molten metal pouring operation is produced.

Figure 3:
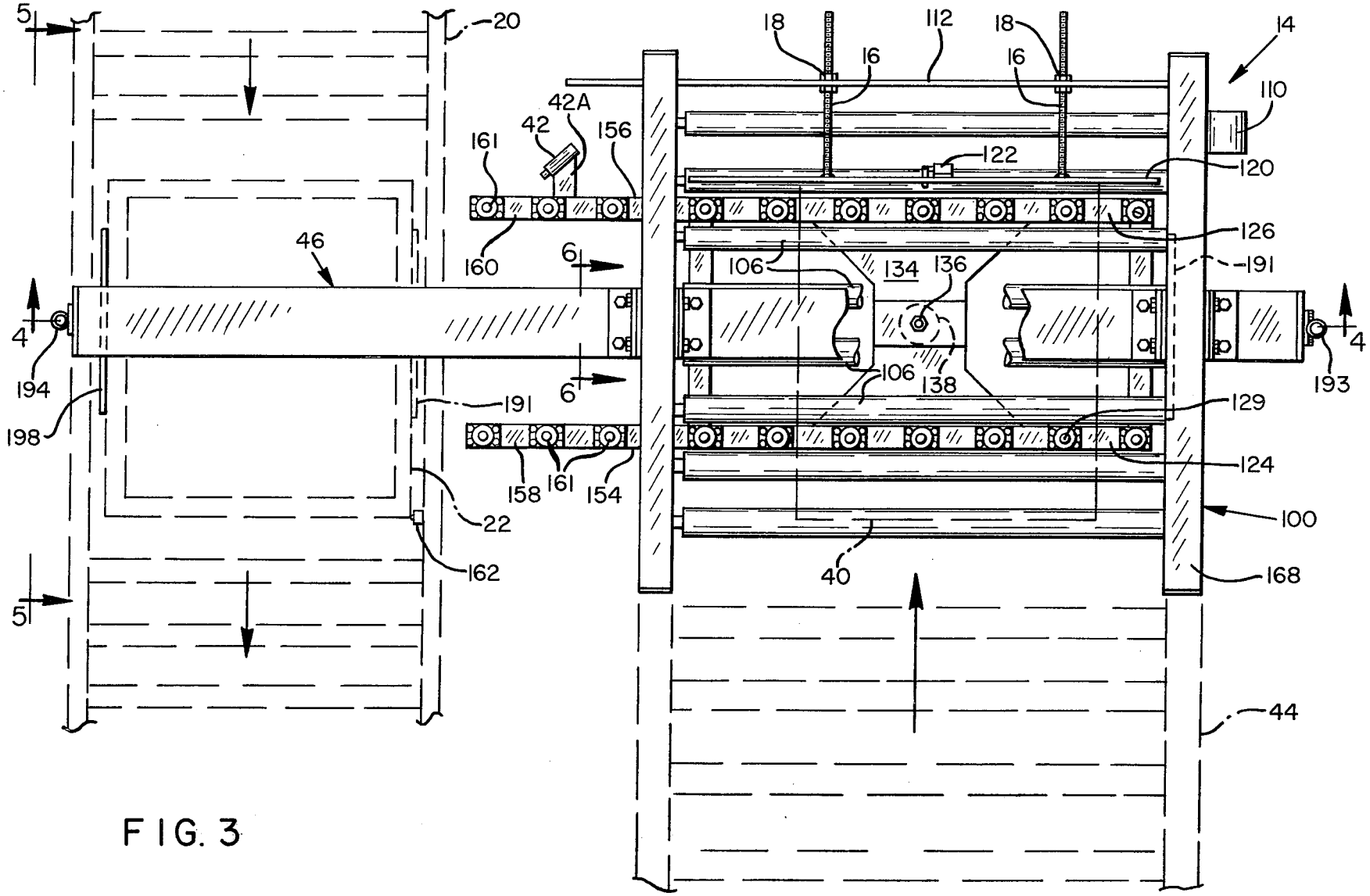
FIG. 3 is an enlarged top plan view of the bottom board feeder apparatus shown in FIG. 1 with parts broken away. A bottom board, a mold box, and portions of the main and return conveying lines are shown in phantom lines.

Referring to FIG. 3, the illustrated embodiment of the bottom board feeder apparatus 14 of the present invention includes a box-like frame 100 positioned at the end of the return conveying line 44. The frame 100 is comprised of interconnected horizontal and vertical members. A box beam 102 and an L-beam 104 (FIG. 4) are mounted on opposite sides of the frame 100 and a plurality of laterally extending, spaced apart, horizontal conveying rollers 106 (FIGS. 3–5) are rotatably journaled at their ends in the beams 102 and 104. The upper peripheries of the conveying rollers 106 are at substantially the same level as the upper peripheries of the conveying rollers of the return line 44. The conveying rollers 106 are drivingly interconnected by a sprocket and chain assembly 108 (FIG. 4) contained within the box beam 102 so that they can be simultaneously rotated in the same direction for conveying the bottom board 40 thereon from the return conveying line 44. One of the rollers 106 is drivingly connected to a three phase induction motor 110 mounted on the frame 100.

A laterally extending vertical support plate 112 (FIGS. 3 and 5) is rigidly secured to vertical members 114 of the frame 100. The support plate 112 has four rectangularly spaced apertures therethrough which slidably receive respective threaded horizontally extending rods 116. Nuts 118 on the rods 116 are tightened against the opposite sides of the support plate 112. The ends of the rods 116 remote from the support plate 112 are welded to a laterally extending vertical guide plate 120. The guide plate 120 stops the bottom board 40 on the rollers 106 so that it is longitudinally aligned with the mold box 22 on the main conveying line 20. The longitudinal position of the guide plate 120 can be adjusted by loosening the nuts 118, changing the extension of the rods 116 relative to the support plate 112, and then retightening the nuts 118 against the support plate 112. This allows bottom boards and mold boxes of different longitudinal dimensions to be accommodated. A limit switch 122 is mounted on the lower periphery of the guide plate 120 and is actuated when the bottom board 40 hits the guide plate 120.

Figure 4:
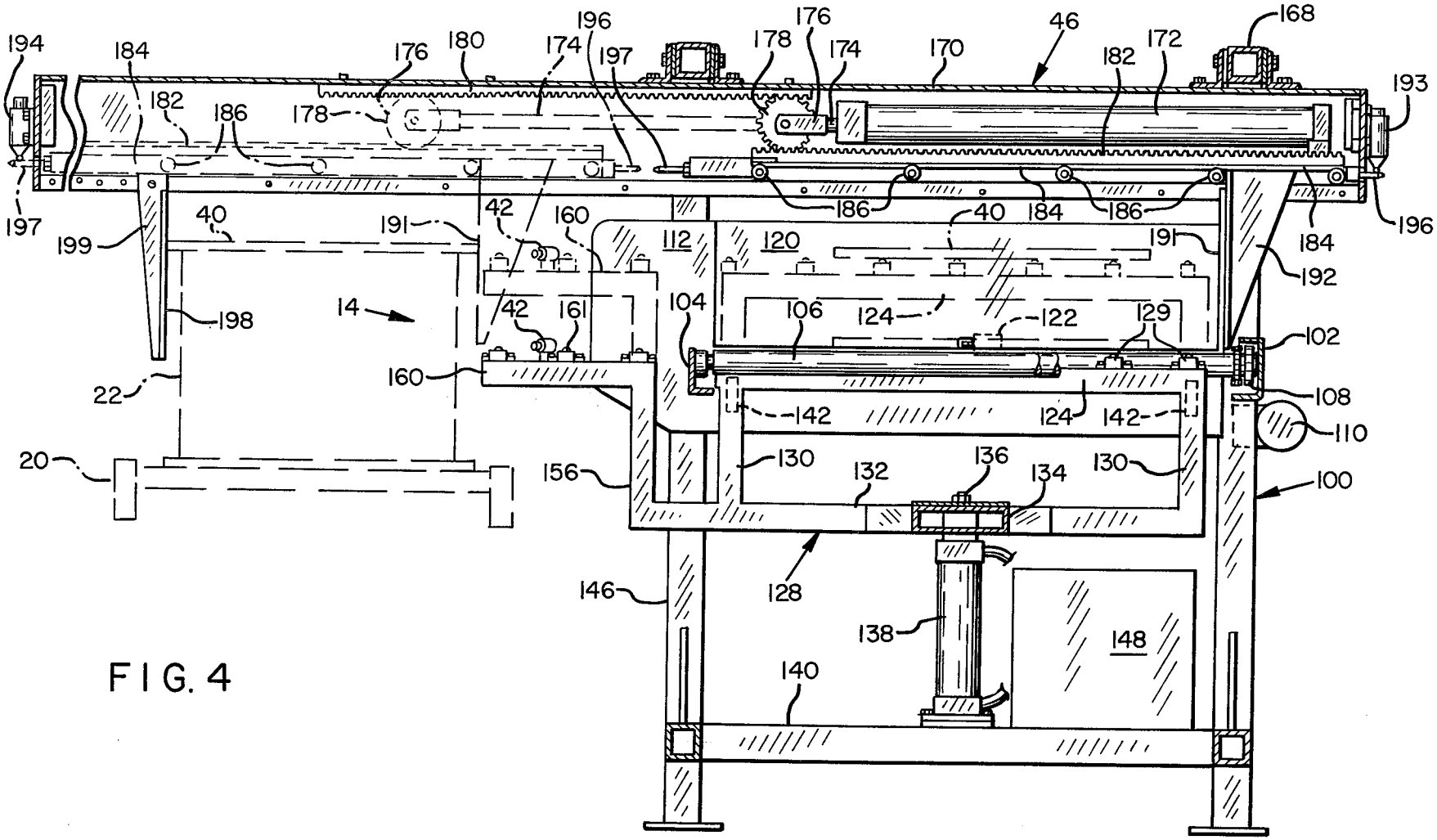
FIG. 4 is a sectional view of the bottom board feeder apparatus of FIG. 3 taken along line 4—4 of FIG. 3. The manner in which a bottom board is raised and fed onto the top of a mold box is illustrated in phantom lines.
Figure 5:
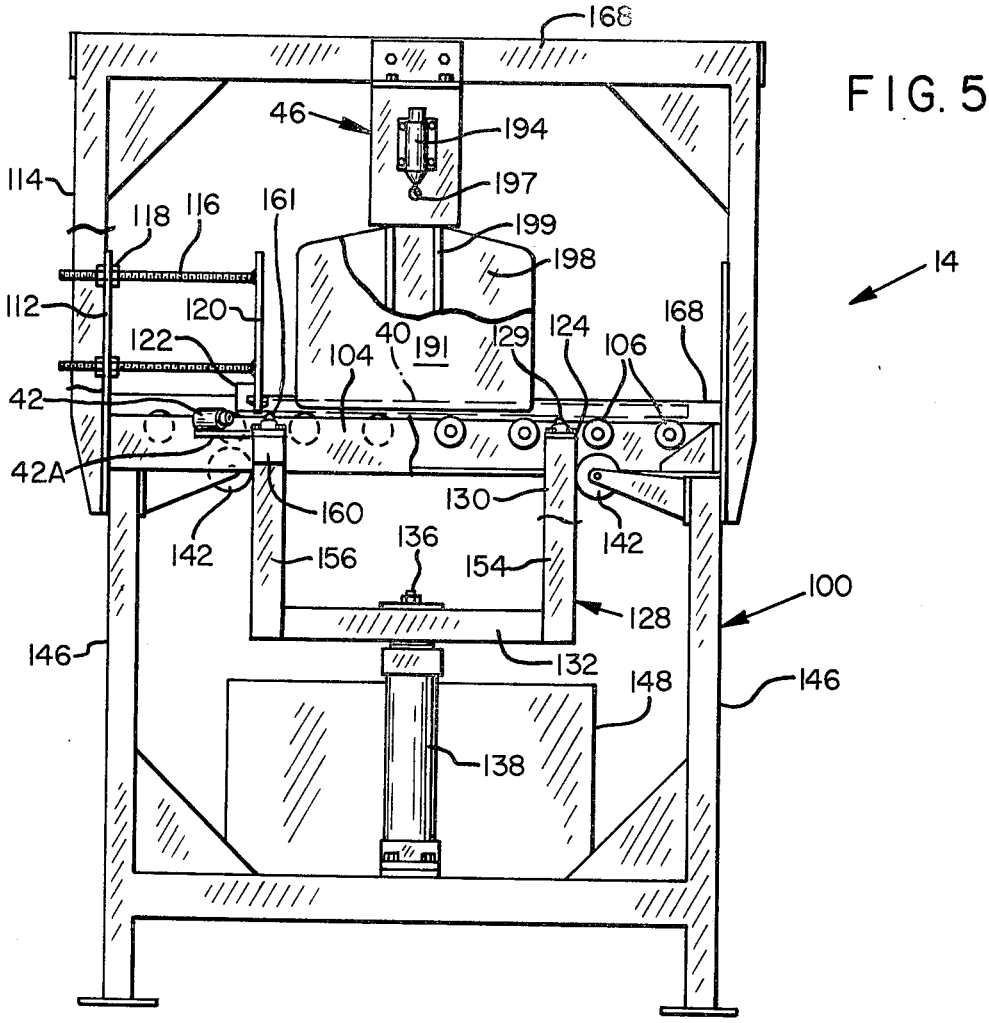
FIG. 5 is an elevational view of the bottom board feeder apparatus of FIG. 3 taken along line 5—5 of FIG. 3 with parts broken away.

A pair of laterally extending, spaced apart, horizontal rails 124 and 126 (FIGS. 3 and 4) are positioned between pairs of the rollers 106 below the upper peripheries of the rollers and are supported by a U-shaped yoke assembly 128 (FIGS. 4 and 5). The rails 124 and 126 have a plurality of ball and socket rollers 129 (FIGS. 3–5) to facilitate lateral sliding of the bottom board. The yoke assembly 128 includes four rectangularly spaced arms 130 (FIGS. 4 and 5) which extend vertically from a rectangular frame 132. The frame 132 of the yoke assembly 128 has a centrally positioned member 134 (FIG. 3) which is secured to the piston rod 136 of a vertically extending hydraulic cylinder 138 (FIGS. 4 and 5) mounted on a centrally positioned lower horizontal member 140 (FIG. 4) of the frame 100. The vertical arms 130 of the yoke assembly 128 engage guide wheels 142 (FIG. 5) rotatably mounted on brackets 144 attached to vertical members 146 of the frame 100.

A conventional hydraulic fluid tank and pump assembly 148 is mounted to the lower portion of the frame 100. It supplies hydraulic fluid under pressure to the hydraulic cylinder 138 through hoses (not shown). The hydraulic cylinder 138 is actuable to raise the yoke assembly 128 so that the ball and socket rollers 129 engage the bottom surface of the bottom board 40. As the piston rod 136 of the hydraulic cylinder 138 continues to extend the vertical arms 130 of the yoke assembly 128 will extend between the rollers 106 and the bottom board 40 will be raised off of the rollers 106, as shown in phantom lines in FIG. 4.

L-shaped arms 154 and 156 (FIGS. 3 and 4) are attached to the yoke assembly 128 and horizontal rails 158 and 160 are attached to the upper ends of the arms 154 and 156 respectively. The rails 158 and 160 are generally co-linear with the rails 124 and 126 and also have a plurality of ball and socket rollers 161 to facilitate lateral transfer of the bottom board.

The infrared proximity sensor 42 is mounted on a bracket 42A attached to the rail 160. Its scanning beam is aimed horizontally across the portion of the main conveying line 20 which is occupied by the mold box 22 when the box is stopped in its board receiving position shown in FIGS. 3 and 4. Mounted on the main conveying line 20 is a momentary switch 162 which is momentarily closed when the mold box 22 is stopped in its board receiving position. The control effected thereby will be described subsequently. When the mold box 22 is stopped in its board receiving position it will intercept the scanning beam of the sensor 42 which will detect the presence of the mold box. When the yoke assembly 128 is raised, the sensor 42 is also raised. As will be explained later on in greater detail, when the horizontal scanning beam of the sensor 42 is raised above the upper edges or upper surface of the mold box 22 the sensor no longer senses the presence of the mold box and the signal generated thereby causes the yoke assembly 128 (and the bottom board 40) to stop rising.

The bottom board 40 must be elevated sufficiently so that its bottom surface is at least as high as the top surface of the mold box 22. Therefore, as shown in FIG. 5, the sensor 42 is mounted on the rail 160 so that its scanning beam is at or below the level of the bottom surface of the bottom board 40 when the board is supported on top of the ball and socket rollers 129.

Figure 6:
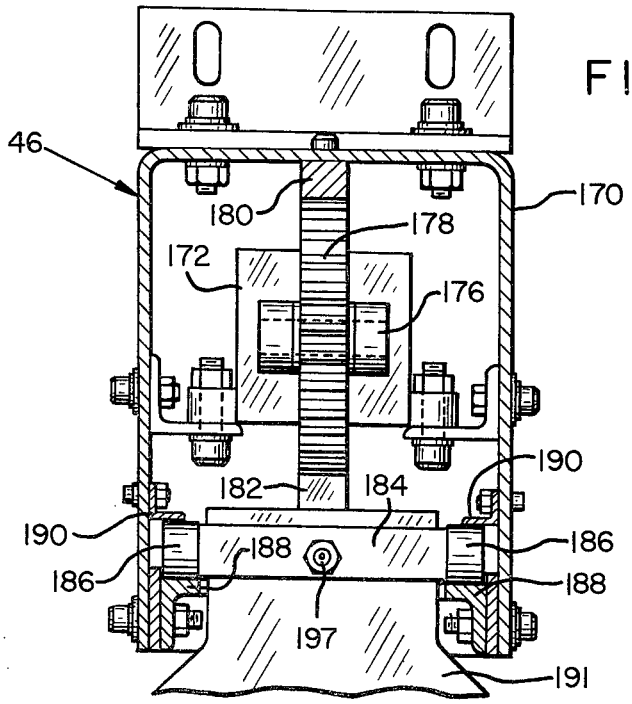
FIG. 6 is a cross-sectional view of the shuttle mechanism of the bottom board feeder apparatus of FIG. 3 taken along line 6—6 of FIG. 3.

The laterally extending shuttle mechanism 46 (FIGS. 3–5) is suspended from a pair of upper horizontal members 168 of the frame 100. The shuttle mechanism 46 includes an elongate, hollow, open-bottom box beam 170 (FIGS. 4 and 6). The beam 170 encloses a hydraulic cylinder 172 which is supplied with hydraulic fluid under pressure from the assembly 148 through hoses (not shown). The piston rod 174 of the hydraulic cylinder 172 is connected to a fork 176 which rotatably supports a pinion gear 178. The pinion gear 178 engages a rack gear 180 rigidly mounted to the top of the box beam 170 and a rack gear 182 rigidly mounted to the top of a movable shuttle carriage 184. The wheels 186 of the shuttle carriage 184 travel along elongate, L-shaped tracks 188 secured to the opposite sidewalls of the box beam 170. Elongate, L-shaped guards 190 secured to the opposite sidewalls of the box beam 170 above the tracks 188 help to prevent the shuttle carriage 184 from tilting off of the tracks. The shuttle carriage 184 will extend two units of distance for every unit of distance that the piston rod 174 of the hydraulic cylinder 172 extends.

A downwardly depending shuttle blade 191 (FIGS. 4–6) having reinforcing fins 192 is secured to the shuttle carriage 184 between the wheels 186 thereof. The width of the shuttle blade 191 is sufficiently small so that it can fit between the rails 124 and 126 and between the rails 158 and 160. The shuttle carriage 184 and the shuttle blade 191 carried thereby are moved by the hydraulic cylinder 172 between a retracted position (shown in solid lines) and an extended position (shown in phantom lines). The shuttle blade 191 pushes the bottom board 40 so that it slides laterally over the ball and socket rollers 129 on the rails 124 and 126, over the ball and socket rollers 161 on the rails 158 and 160, and onto the top surface of the mold box 22.

The retracted and extended positions of the shuttle carriage 184 and the shuttle blade 191 are determined by limit switches 193 and 194 (FIG. 4) attached to the opposite ends of the box beam 170. The limit switches 193 and 194 are actuated by actuator rods 196 and 197 respectively which are screwed into the opposite ends of the shuttle carriage 184. The extension of the rods 196 and 197 relative to the shuttle carriage 184 can be adjusted to vary the retracted and extended positions of the shuttle carriage 184 and the shuttle blade 191. Alternatively, the actuator rods 196 and 197 may be replaced with actuator rods of different lengths to accomplish the same result.

A downwardly depending stop plate 198 (FIGS. 4 and 5) having reinforcing fins 199 is secured to the end of the box beam 170 remote from the frame 100. The stop plate 198 prevents the bottom board 40 from sliding too far over the mold box 22. In addition, the hydraulic cylinder 172 preferably has an internal damper spring (not shown) so that as the piston rod 174 nears its point of greatest extension, its speed of extension decreases. Thus, the bottom board 40 initially slides relatively quickly over the ball and socket rollers 129 on the rails 124 and 126. When the bottom board is nearly in position on top of the mold box 22 it slides relatively slowly so that its inertia does not carry it past the point where it completely covers the mold box.

Preferably, the shuttle blade 191 can be secured at different points along the length of the shuttle carriage 184. Also preferably the stop plate 198 can be secured at different points along the length of the box beam 170. This allows bottom boards and mold boxes of different lateral dimensions to be accommodated.

Figure 7:
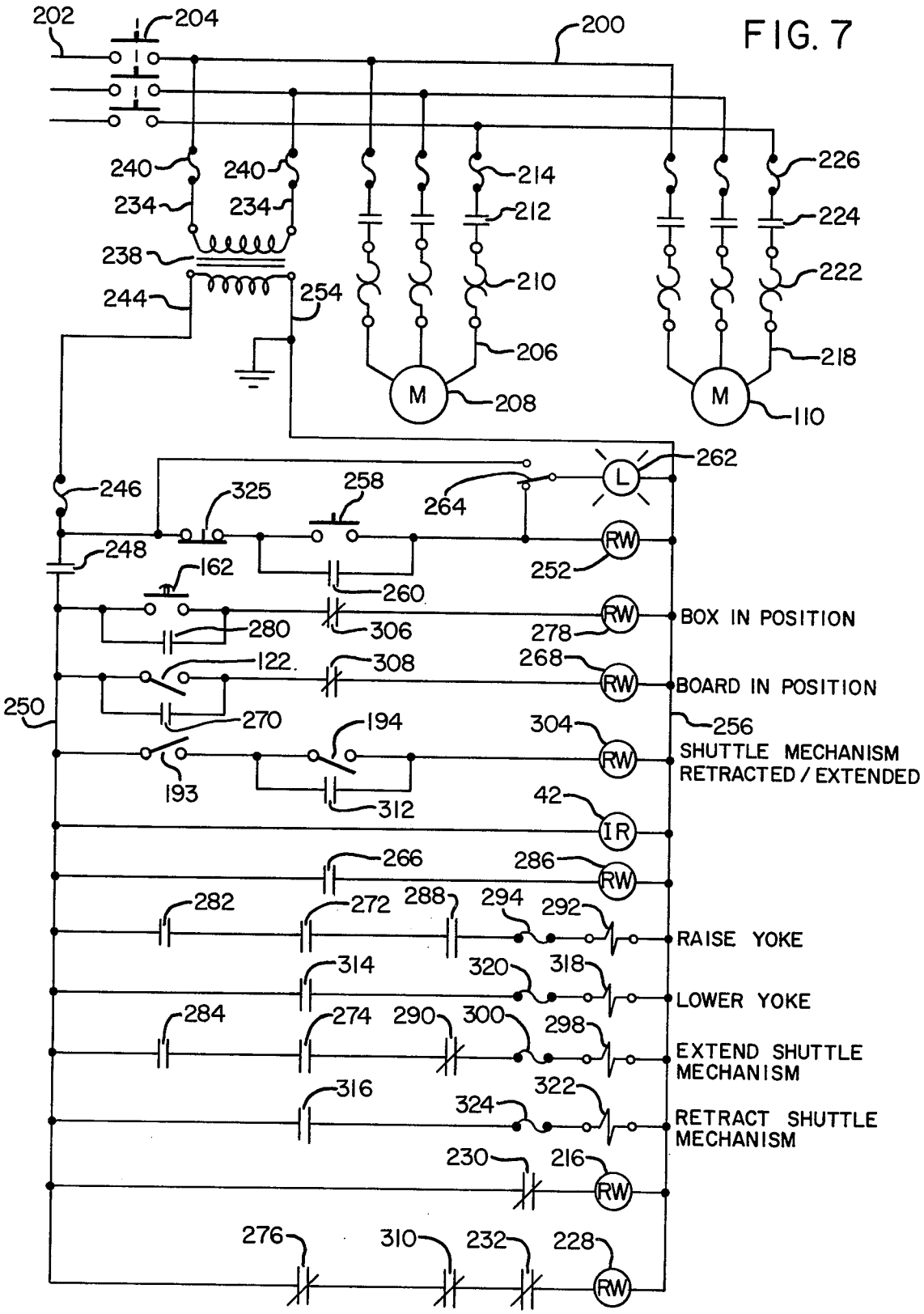
FIG. 7 is a schematic diagram of the electrical circuit forming a part of the control system of the bottom board feeder apparatus of FIG. 3.

The operation of the bottom board feeder apparatus 14 will now be described in connection with an explanation of its control system which includes electrical and hydraulic circuits shown in FIGS. 7 and 8. Referring to FIG. 7, conductors 200 are connected to electric lines 202 by throwing a manual circuit breaker switch 204. The electric lines 202 are connected to a 60 Hertz, three phase, AC electric power source.

The leads 206 of a three phase induction motor 208, which drives the hydraulic fluid pump of the assembly 148, are each connected to one terminal of individual melting alloy units 210. The other terminals of the melting alloy units 210 are each connected to relay contacts 212 which are in turn connected to the conductors 200 through fuses 214. The relay contacts 212 are associated with a relay winding 216.

In a similar fashion, the leads 218 of the three phase induction motor 110, which drives the conveying rollers 106, are each connected to one terminal of melting alloy units 222. The other terminals of the melting alloy units 222 are each connected to relay contacts 224 which are in turn connected to the conductors 200 through fuses 226. The relay contacts 224 are associated with a relay winding 228.

The melting alloy units 210 are mechanically ganged. During the operation of the apparatus, if any one of the units 210 melts due to an overload or phase loss, all of them will melt. This will cause contacts 230 associated with the relay winding 216 to open, thereby de-energizing the relay winding 216 and causing the relay contacts 212 to open. The motor 208 will thus be protected from damage due to overload or phase loss.

Similarly, the melting alloy units 222 are also mechanically ganged. During the operation of the apparatus, if any one of the units 222 melts due to an overload or phase loss, all of them will melt which will cause contacts 232 to open, thereby de-energizing the relay winding 228 and causing the relay contacts 224 to open. The motor 110 will thus also be protected from damage due to overload or phase loss.

The leads 234 of the primary winding of a transformer 238 are connected to two of the conductors 200 through fuses 240. One lead 244 of the secondary winding of the transformer 238 is connected through a fuse 246 and through relay contacts 248 to a bus generally designated 250. The relay contacts 248 are associated with a master control relay winding 252. The other lead 254 of the secondary winding of the transformer 238 is grounded and is connected to a bus generally designated 256. The remaining components of the electrical circuit are connected between the buses 250 and 256.

The bottom board feeder apparatus is started by depressing a momentary switch 258 which causes the master control relay winding 252 to be energized. This in turn causes the relay contacts 248 and 260 associated with the master control relay winding 252 to close. The relay winding 216 is energized which closes the relay contacts 212. The motor 208 is energized and hydraulic fluid begins to flow through the hydraulic circuit. At the same time, the relay winding 228 is energized which closes the relay contacts 224. The motor 110 is energized and the conveying rollers 106 of the bottom board feeder 14 are rotated.

As soon as the momentary switch 258 is depressed an indicator lamp 262 lights up to indicate that the bottom board feeder is in its "power on" mode. If the lamp 262 does not light up when the switch 258 is depressed, a testor switch 264 can be manually thrown. If the lamp 262 then lights up, the relay winding 252 and the relay contacts 260 should be checked for defects.

As soon as the relay contacts 248 close, the infrared proximity sensor 42 is energized. At this point, the mold box 22 has not yet reached its board receiving position. The infrared proximity sensor senses the absence of a mold box and relay contacts 266 associated with the infrared proximity sensor 42 remain open.

The bottom board 40 is conveyed off of the return conveying line 44 onto the rollers 106. Eventually the board strikes the guide plate 120 and the limit switch 122 is closed. A relay winding 268 is energized which causes relay contacts 270, 272 and 274 to close and relay contacts 276 to open. When the relay contacts 276 open, the relay winding 228 is de-energized which in turn causes the relay contacts 224 to open. This de-energizes the motor 110 which in turn causes the conveying rollers 106 of the bottom board feeder to cease rotating.

When the mold box 22 arrives at its bottom board receiving position it momentarily closes the momentary switch 162 which causes relay winding 278 to be energized. This in turn causes relay contacts 280, 282 and 284 to close. The infrared proximity sensor 42 senses the presence of the mold box 22 and closes the relay contacts 266. This energizes relay winding 286 which closes relay contacts 288 and opens relay contacts 290.

At this point, relay contacts 272, 282 and 288 are all closed and a solenoid 292 protected by a fuse 294 is energized. The solenoid 292 shifts a four way, three position, spring centered, hydraulic fluid valve 296 (FIG. 8) so that hydraulic fluid flows into the hydraulic cylinder 138 and causes the piston rod 136 to extend. The yoke assembly 128 which supports the bottom board 40 rises until the infrared proximity sensor 42 carried thereby no longer senses the presence of the mold box 22, indicating that the bottom board has been raised to the appropriate height.

Immediately at this point the relay contacts 266 (FIG. 7) are opened which in turn de-energizes the relay winding 286. The relay contacts 288 open and the relay contacts 290 close. The solenoid 292 is de-energized and since the valve 296 is spring centered it switches back to its middle position. When the valve 296 is in this position, hydraulic fluid cannot flow into or out of the hydraulic cylinder 138. The piston rod 136 of the hydraulic cylinder 138 stops in its extended position. The yoke assembly 128 and bottom board 40 stop in their raised positions.

At this point, the shuttle mechanism 166 is retracted. The limit switches 193 and 194 are open. The relay contacts 274, 284 and 290 are all closed and a solenoid 298 which is protected by a fuse 300 is energized. The solenoid 298 switches a four way, three position, spring centered, hydraulic fluid valve 302 (FIG. 8) so that hydraulic fluid flows into the hydraulic cylinder 172 and causes the piston rod 174 to extend.

As soon as the piston rod 174 of the cylinder 172 begins to extend the limit switch 193 (FIG. 7) closes. The piston rod 174 continues to extend and the shuttle blade 191 pushes the bottom board 40 onto the top of the mold box 22. When the shuttle mechanism 166 has fully extended the limit switch 194 is closed. This energizes relay winding 304 which in turn opens relay contacts 306, 308 and 310 and closes relay contacts 312, 314 and 316. The relay winding 278 is de-energized which causes the relay contacts 280, 282 and 284 to open. The solenoid 298 is de-energized which causes the valve 302 to shift back to its middle position in which hydraulic fluid cannot flow into or out of the hydraulic cylinder 172. The piston rod 174 of the hydraulic cylinder 172 stops in its extended position. The shuttle blade 191 stops in its extended position.

The opening of the relay contacts 308 causes the relay winding 268 to be de-energized which in turn opens the relay contacts 270, 272 and 274 and closes the relay contacts 276. The closing of the relay contacts 314 energizes a solenoid 318 protected by a fuse 320. The solenoid 318 shifts the valve 296 (FIG. 8) to its flow reversing position. The piston rod 136 of hydraulic cylinder 138 retracts and the yoke assembly 128 is lowered back to its original position.

The closing of the relay contacts 316 (FIG. 7) energizes a solenoid 322 which is protected by a fuse 324. The solenoid 322 shifts the valve 302 (FIG. 8) to its flow reversing position. The piston rod 174 of the hydraulic cylinder 172 retracts and the shuttle blade 191 moves back to its retracted position. The limit switches 193 and 194 (FIG. 7) open, de-energizing the relay winding 304. This in turn closes the relay contacts 306, 308 and 310 and opens the relay contacts 312, 314 and 216. The relay contacts 276 and 310 are now closed which causes the relay winding 228 to be energized. The relay contacts 224 are closed and the motor 110 is energized. The conveying rollers 106 of the bottom board feeder are again rotated.

The opening of the relay contacts 314 de-energizes the solenoid 318 which causes the valve 296 (FIG. 8) to shift back to its middle position. The opening of the relay contacts 316 (FIG. 7) de-energizes the solenoid 322 and causes the valve 302 (FIG. 8) to shift back to its middle position.

As soon as the yoke assembly 128 begins to descend, the infrared proximity sensor 42 (FIG. 7) senses the presence of the mold box 22 and closes the relay contacts 266. This energizes the relay winding 286. The relay contacts 288 are closed and the relay contacts 290 are opened. This completes the cycle of operation.

A momentary switch 325 may be depressed to place the bottom board feeder into its "power off" mode. This may be done at the conclusion of any number of cycles, or during a cycle in case of an emergency.

Referring to FIG. 8, the hydraulic circuit also includes a pressure release valve 326 which protects the components of the hydraulic circuit if potentially damaging high fluid pressure should arise. The hydraulic fluid may be routed through a variable flow control valve 328. The valve 328 may be adjusted to vary the amount of hydraulic fluid which is bypassed directly into the hydraulic fluid tank of the assembly 148. This will in turn vary the speed at which the piston rods 136 and 174 of the hydraulic cylinders 138 and 172 respectively retract and extend. A meter 330 indicates hydraulic fluid pressure. A solenoid actuated, four way, two position, spring biased hydraulic valve 332 is actuable to direct hydraulic fluid through the variable flow control valve 328 and the meter 330.

It is apparent that many modifications and variations may be made in the invention. For example, photoelectric, magnetic, or other proximity sensing mechanisms may be substituted for the infrared sensor 42. Solid state switching circuits may be substituted for the relay control circuit shown in FIG. 7. The bottom board feeder apparatus and the other apparatuses making up the successive stations of the multi-station sand mold making apparatus may be simultaneously controlled by a central, solid state programmable control system. Electric motors and gear drives may be substituted for the hydraulic cylinders. The construction of the frame, yoke assembly, rails, and shuttle mechanism can be varied so that the bottom board feeder apparatus will adapt to multi-station sand mold making apparatus of varying configurations. For example, the rails 158 and 160 may be eliminated when the conveying lines are sufficiently close. The ball and socket rollers 129 and 161 can be removed and the board can be slid along the top surfaces of the rails 124, 126, 158 and 166. If mold boxes of uniform height are to be utilized in the multi-station sand mold making apparatus, the proximity sensor and the elevating mechanism can be eliminated. The rollers 106 would then have to be high enough so that the bottom surface of a bottom board 40 supported thereon would be at least as high as the top surface of a mold box in the board receiving position. However, such modifications and adaptations, as well as others, are within the spirit and scope of the present invention.

What is claimed is:

1. In an apparatus for feeding boards onto the top surfaces of boxes of varying heights, the boards being supplied in succession to the apparatus by a first conveying line, and the boxes being supplied in succession to a board receiving position adjacent the first conveying line by a second conveying line, sensing means for detecting the height of a box supplied to the position, elevating means responsive to the sensing means for raising a board supplied to the apparatus so that the bottom surface of the board is at least as high as the top surface of the box, and shuttle means for pushing the board onto the top surface of the box after the board has been raised.

2. An apparatus for feeding boards from the end of a first conveying line which supplies a succession of boards, laterally onto the top surfaces of boxes of varying heights carried along in succession by an adjacent second conveying line which positions the boxes adjacent the apparatus, the apparatus comprising:

a support positioned at the end of the first conveying line for receiving a board therefrom, means for conveying the board onto the support from the first conveying line, sensing means for detecting the height of a box positioned on the second conveying line adjacent the support, elevating means for raising the board positioned on the support, the elevating means including means for supporting the board and means actuated by the sensing means for raising the supporting means from a retracted position to an extended position in which the supporting means is supporting the board so that the bottom surface of the board is at least as high as the top surface of the box, and shuttle means for laterally pushing the board off of the supporting means onto the top surface of the box after the supporting means has been raised to its extended position.

3. The apparatus of claim 2 and further comprising control means for automatically controlling the cyclical operation of the apparatus.

4. An apparatus for feeding boards from the end of a first conveying line which supplies a succession of boards, laterally onto the top surfaces of boxes of varying heights carried along in succession by an adjacent second conveying line which momentarily stops the boxes adjacent the apparatus, the apparatus comprising:

a frame positioned at the end of the first conveying line, a plurality of laterally extending, spaced apart, horizontal rollers mounted on the frame, means for driving the rollers to convey a board thereon from the first conveying line, sensing means for detecting the height of a box which is stopped on the second conveying line adjacent the frame, elevating means mounted on the frame for raising the board, the elevating means including a pair of laterally extending, spaced apart, horizontal rails and means actuated by the sensing means for raising the rails from a retracted position in which the rails are positioned between the rollers below the upper peripheries of the rollers, to an extended position in which the rails are supporting the board so that the bottom surface of the board is at least as high as the top surface of the box, and shuttle means mounted on the frame for laterally pushing the board off of the rails onto the top surface of the box after the rails have been raised to their extended position.

5. The apparatus of claim 4 wherein the shuttle means includes an elongate beam supported on the frame and extending laterally above the rollers and above the box, a carriage adapted to travel back and forth along the length of the beam, a downwardly extending blade secured to the carriage and adapted to engage the board for pushing it laterally, and means for moving the carriage from a retracted position to an extended position so that the blade will laterally push the board off of the rails and onto the top surface of the box.

6. The apparatus of claim 4 and further comprising a laterally extending, vertical guide plate mounted on the frame for stopping the board on the rollers in alignment with the box and for guiding the board off of the rails toward the box as it is being pushed by the shuttle means.

7. The apparatus of claim 4 wherein the elevating means further includes a yoke assembly for supporting the rails, and the means for raising the rails includes a vertically extending hydraulic cylinder mounted on the frame and having an upwardly extending piston rod secured to the yoke assembly.

8. The apparatus of claim 7 and further comprising means extending laterally from the yoke assembly for slidably supporting the board as it is being pushed between the rails and the top surface of the box.

9. The apparatus of claim 4 and further comprising control means for automatically controlling the cyclical operation of the apparatus.

10. An apparatus for feeding boards from the end of a first conveying line which supplies a succession of boards, onto the top surface of boxes carried along in succession by an adjacent second conveying line which positions the boxes adjacent the apparatus, the apparatus comprising:

a support positioned at the end of the first conveying line for receiving a board therefrom, means for conveying the board onto the support from the first conveying line, and shuttle means for pushing the board off of the support onto the top surface of a box positioned on the second conveying line adjacent the support, the shuttle means including an elongate beam extending above the support and above the box, a carriage adapted to travel back and forth along the length of the beam, a downwardly extending blade secured to the carriage and adapted to engage the board for pushing it, and means for moving the carriage from a retracted position to an extended position so that the blade will push the board off of the support and onto the top surface of the box.

11. The apparatus of claim 10 wherein the board conveying means includes a plurality of rollers mounted on the support, and means for driving the rollers to convey a board thereon from the first conveying line.

12. The apparatus of claim 11 and further comprising a guide plate mounted on the support for stopping the board on the rollers in alignment with the box and for guiding the board off of the rollers toward the box as it is being pushed by the blade.

* * * * *